US005502907A

United States Patent [19]

Wang

[11] Patent Number: 5,502,907

[45] Date of Patent: Apr. 2, 1996

[54] INNOVATED FRAME FIXATION STRUCTURE

[76] Inventor: Thomas T. M. Wang, 7th Fl.-3, No. 129, Section 1, Fu-Hsing S. Rd., Taipei City, Taiwan

[21] Appl. No.: 373,850

[22] Filed: Jan. 18, 1995

[51] Int. Cl.[6] ..... A47G 1/17

[52] U.S. Cl. ..... 40/711; 40/768; 40/600; 248/455; 248/463

[58] Field of Search ..... 40/152, 152.1, 40/156, 600; 248/455, 463

[56] References Cited

U.S. PATENT DOCUMENTS

| | | | |
|---|---|---|---|
| 2,448,580 | 9/1948 | Crosby | 40/152.1 |
| 4,290,216 | 9/1981 | Gale | 40/152.1 |
| 4,852,284 | 8/1989 | Faggiano | 40/600 X |
| 5,082,230 | 1/1992 | Chang | 248/455 X |
| 5,172,503 | 12/1992 | Dane et al. | 40/152.1 X |

FOREIGN PATENT DOCUMENTS

| | | | |
|---|---|---|---|
| 2220138 | 1/1990 | United Kingdom | 40/156 |

*Primary Examiner*—Peter M. Cuomo
*Assistant Examiner*—James O. Hansen
*Attorney, Agent, or Firm*—Morton J. Rosenberg; David I. Klein

[57] ABSTRACT

The frame fixation structure includes frame board, front board, and leg supporter set. Frame board made of opaque material and front board made of transparent material. There are two slotting holes at symmetrical corner on the surface of front board and the same holes at the same sites of frame board opposite to front board. Planted in the holes with magnets so as to attract the two boards together therebetween clamps photos. The leg supporter set includes leg supporter, leg portion and couple-split-muff: leg portion connects leg supporter by screw set so that leg supporter can be bent or twistable; couple-split-muff is used to put around connection part of leg supporter and leg portion so as to strengthen the leg supporter set and avoid the easily brokenness.

1 Claim, 5 Drawing Sheets

INNOVATED FRAME FIXATION STRUCTURE

BACKGROUND OF THE INVENTION

The present invention is related to a frame fixation structure or desk sets and more particularly related to an innovated supporter set and clamp elements of frame fixation structure.

The conventional frame fixation structure comprises back cover board, frame board with variety of affixed clamp elements; put photos on the frame board, covere with back cover board and then clip them with the clamp elements. In order to prevent photos to loss or slipy, a plurality of clamp elements are used so that it forms the conventional frame fixation structure of complicacy, such as some times one has to use tool to dismantle it. It is very unconvenient for use it. Additionally, there is another kind more complicate conventional frame fixation structure which use screws to fasten the front and back boards together so as to clamp firmly the photos which is much more unconvenient of use it. Besides, those leg supporter set of the conventional frame fixation structure is not only breakable but also awkward. For the reasons as above, the inventor of present invention develops the innovated frame fixation structure with the innovated features as following:

1. The innovated frame fixation structure not use any clamp elements but the power of magnets to clamp the photos between back and front boards.
2. Use strong power of magnet to clamp photos, easy for operating and overcome completely all the disadvantages of the conventional frame fixation structure.
3. The innovated frame fixation structure uses couple-split-muff device around the connection part of leg supporter and leg portion which can strengthen the strength of leg supporter set.

SUMMARY OF THE INVENTION

The present invention related to frame fixation structure and more particularly related to the improvement of support portion and clamp elements of frame fixation structure. It comprises front board, frame board, magnet bar and leg supporter set; there are slotting hole each on the symmetrical corner of front board with strong powered magnet planted in the slotting holes and covered with painted cloth on the surface of front board so as no to see magnet from the surface; there are also the slotting holes on same position of frame board opposite to the slotting holes of front board and also planted with strong magnets; a T-shape hole near the slotting hole or at appropriate site of frame board for putting in fixed screw which should be merged in the board so as not to scrape the photos and behind the fixed screw is a leg portion; The strong magnets planted in the slotting holes of front board. The powerful will attrack the said two boards together therebetween clamping the photos; The above mentioned fixed screw set connect the leg portion behind back board. There is recessed furrule on the leg portion with flat rod on the end of recessed furrule and a hole on the flat rod; after leg portion follows leg supporter with splits on its end and a hole through both sides of the two splits; put flat rod of leg portion into the split of leg supporter and then fix them with a pin inserted into the said holes so that leg supporter can be connected the leg portion. A couple-split-muff which is used to put on the connected part of leg supporter and leg portion has elastic strength which prevents the broken of leg supporter set. Nevertheless, both leg supporter and leg portion can be bent or twisted in a smaller size but unbreakable so as to make the innovated frame fixation structure to be used practically and conveniently.

DETAILED DESCRIPTION OF THE PREFERRED EMBODIMENT

Figure 1:
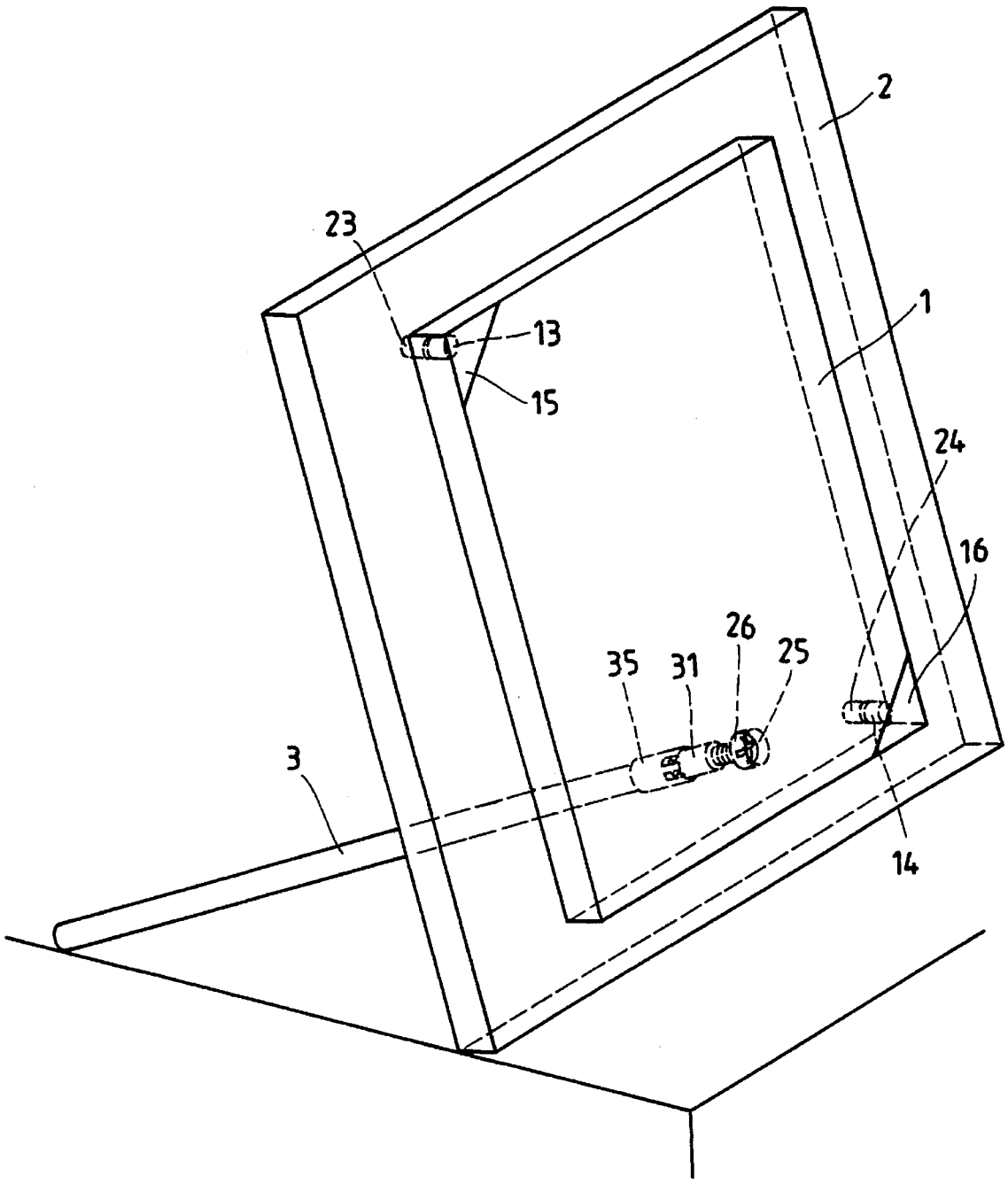
FIG. 1 is the perspective vertical view of the first embodiment of the innovated frame fixation structure.
Figure 2:
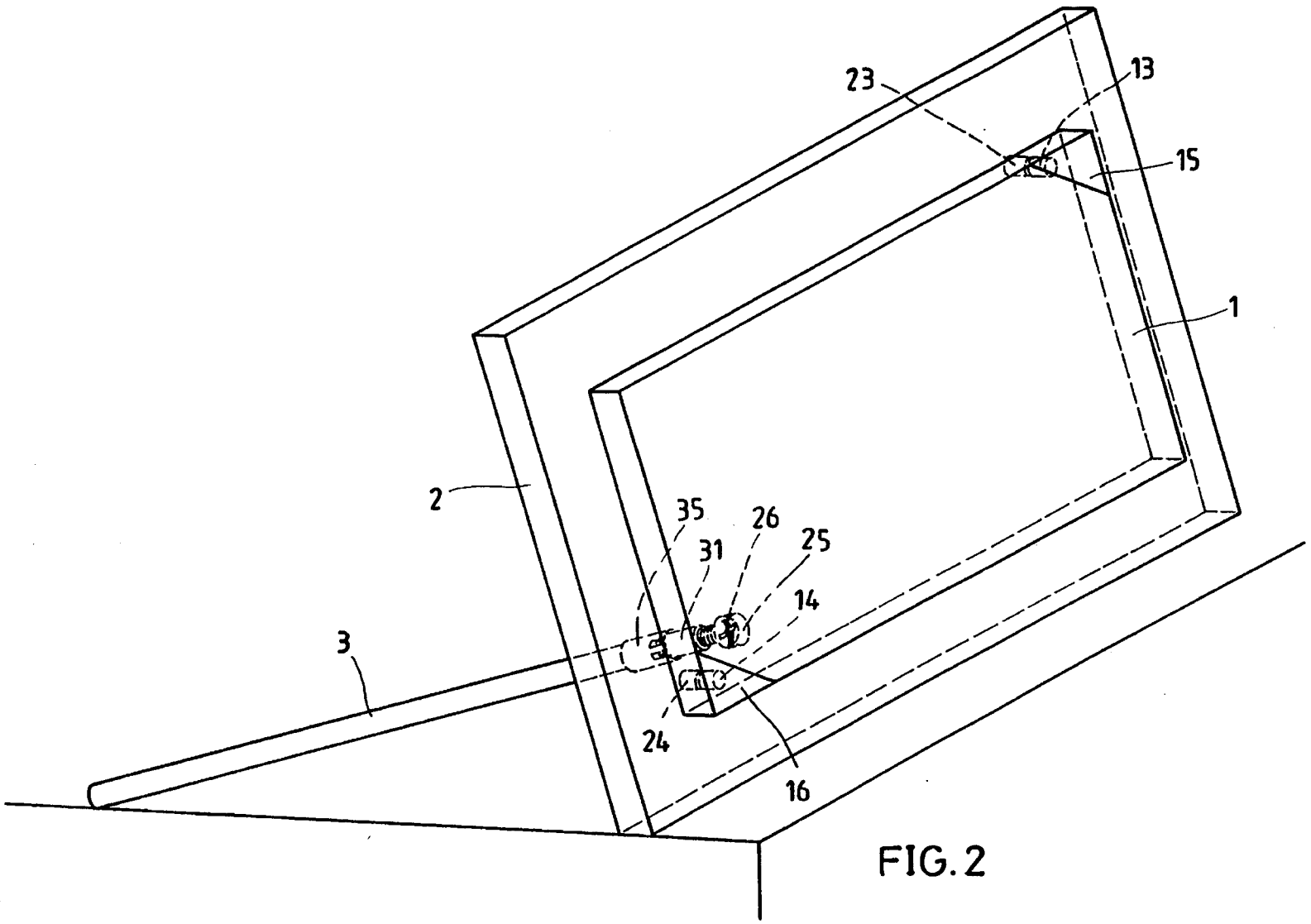
FIG. 2 is the perspective horizontal view of the first embodiment.
Figure 3:
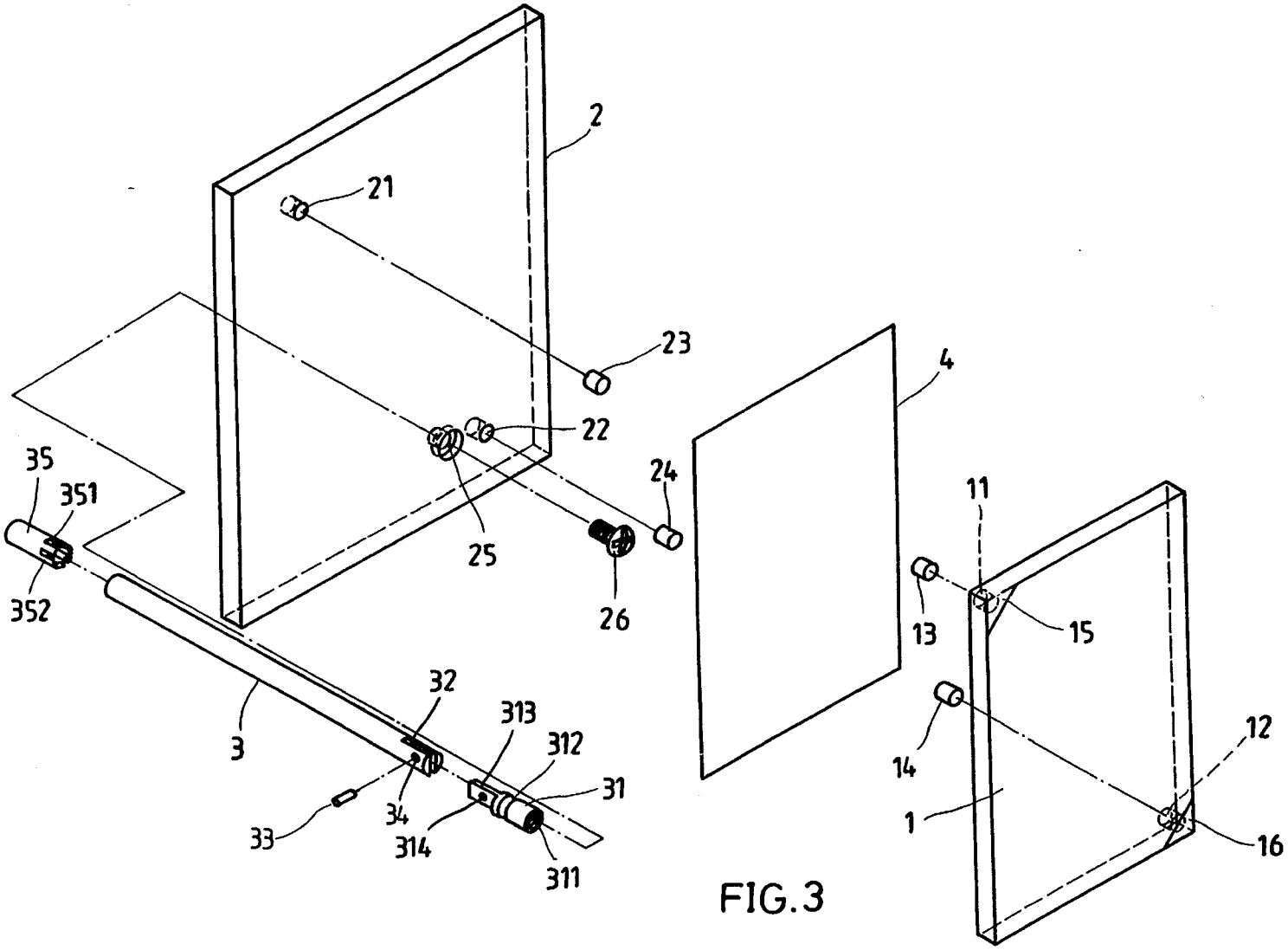
FIG. 3 is the exploded perspective view of the first embodiment.
Figures 4, 4A:
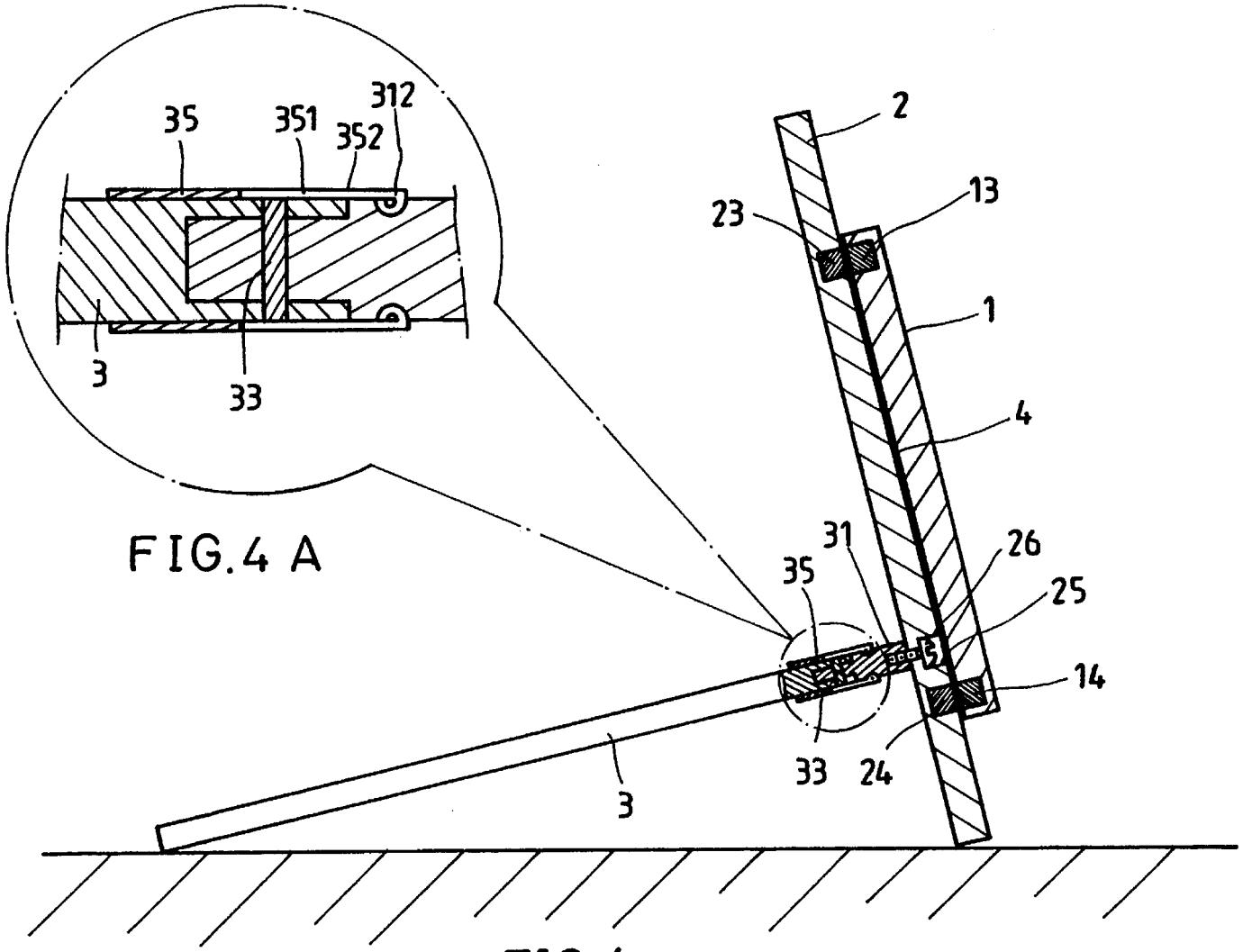
FIG. 4 is the sectional view of the first embodiment.
FIG. 4A is the enlarged perspective view of couple-split-muff separated from the sectional view of the first embodiment.
Figure 5:
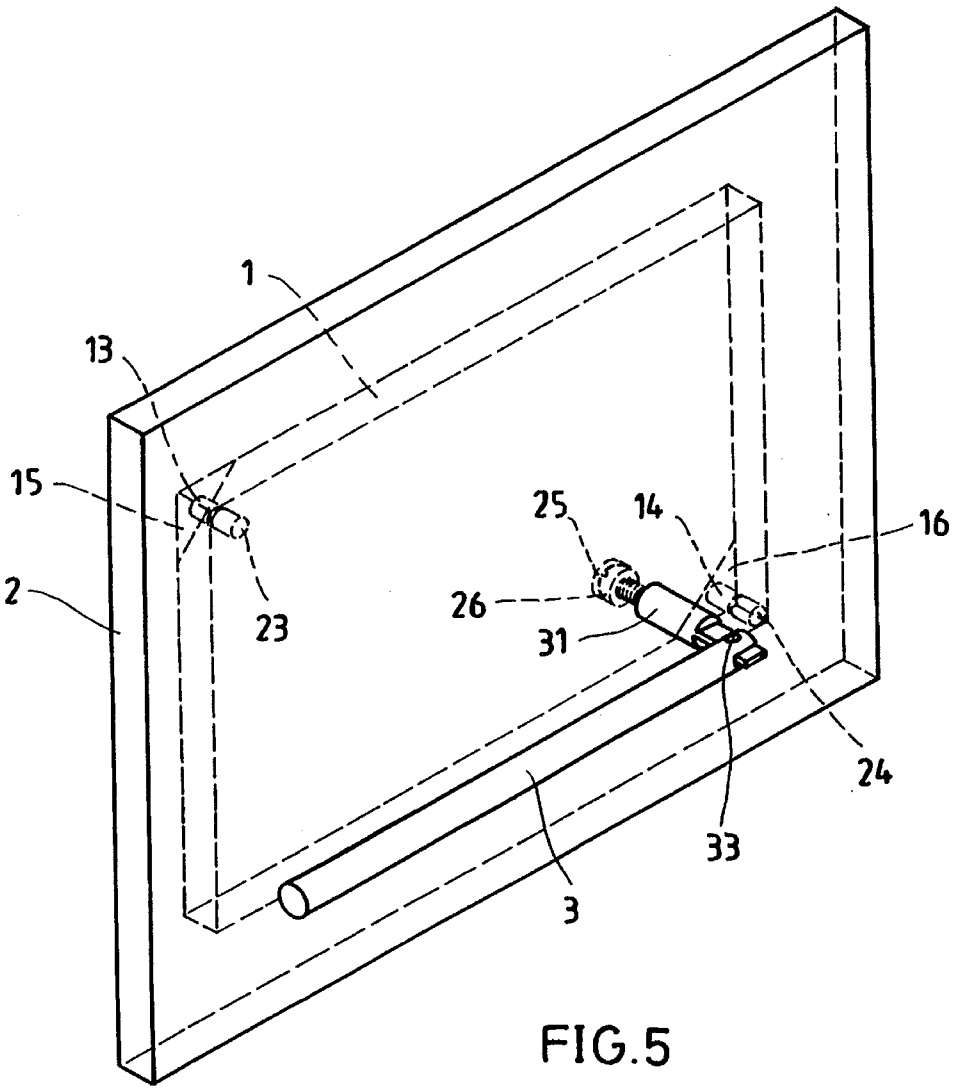
FIG. 5 is the assembled perspective view of the first embodiment of the innovated frame fixation structure and more particular related to the bent leg supporter set.

Referring to FIGS. 1 to 4, the present innovated frame fixation structure comprises front board (1), frame board (2), leg supporter set (3): the front board (1) is a transperent flat board with unthrough slotting holes (11, 12) on symmetrical corner of its inner side and planted with strong power magnets (13, 14) in the slotting holes (11, 12) and further to cover magnets (13, 14) with painted cloth (15, 16) so that the magnets (13, 14) are unvisualizable; at symmetrical corner on the surface of frame board (2) there are also two slotting holes (21, 22) which are of the same size and at same sites of slotting holes (11, 12). The slotting holes (21, 22) also plant with powerful magnet (23, 24). There is T-shape through hole (25) at appropriate site on frame board (2), putting in with the fixed screw (26) with screw cap merged into frame board (2) so as not to scrape photo (4); the fixed screw (26) screws into screw hole (311) of leg portion (31) so as to fix the leg portion (31) on the back of frame board (2). There is recessed furrule (312) and flat rod (313) around and at the end of leg portion (31) respectively. There is a hole (314) on the flat rod (313). There is split (32) at the front end of leg supporter (3). Insert the flat rod (313) into the split (32) and fasten them with a pin (33) into the through hole (34) and the fixed hole (314) so as to fix leg supporter (3) on the flat rod (313) that will make the leg supporter (3) bendable and twistable. The last step is to put couple-split-muff (35) around the connection part between leg supporter (3) and leg portion (31) so as to make leg supporter set either stronger or unbendable.

What is claim is:

1. A frame fixation structure, comprising:

an opaque frame board having opposing front and rear surfaces and a pair of first openings formed in said front surface disposed adjacent opposing corners thereof, said frame board having a through hole formed therein and a circular recess formed in said front surface coaxial said through hole;

a pair of first magnets respectively disposed in said pair of first openings;

a transparent front board having a pair of opposing front and rear sides, said front board overlying said frame board with said front board rear side being contiguous said front surface of said frame board, said front board having a pair of second openings formed in said rear side disposed adjacent opposing corners thereof and in aligned relation with said pair of first openings of said frame board;

a pair of second magnets respectively disposed in said pair of second openings and poled for attraction to said pair of first magnets, whereby said front board is releasably coupled to said frame board and a photo is clampingly held therebetween;

a pair of painted cloth members affixed to said front side of said front board at said opposing corners for masking visibility of said pair of second magnets; and, a leg supporter coupled to said rear surface of said frame board, said leg supporter including (1) a leg portion coupled on a first end thereof to said frame board by a screw having a head portion disposed within said circular recess and passing through said through hole, said leg portion having a second end with a flattened rod shaped contour and an aperture formed therethrough, (2) a longitudinally extended leg support member having one end pivotally coupled to said second end of said leg portion, said one end of said leg support member having a longitudinally directed slotted opening for receiving said flattened second end of said leg portion therein and an aperture formed therethrough disposed in aligned relationship with said aperture formed in said second end of said leg portion, (3) a pivot pin extending through said aligned apertures in said leg support member and said second end of said leg portion, and (4) a tubular sleeve slidably displaceable on said leg support member to overlie said end coupled to said leg portion for preventing pivotal displacement thereof.

* * * * *